US011404834B2

(12) United States Patent
Porter

(10) Patent No.: US 11,404,834 B2
(45) Date of Patent: Aug. 2, 2022

(54) OVERHEAD DOOR LIGHT POWER CONNECTION SYSTEM

(71) Applicant: Argent Innovations, Inc., Everett, WA (US)

(72) Inventor: Ethan S. Porter, Port Ludlow, WA (US)

(73) Assignee: Argent Innovations, Inc., Everett, WA (US)

( * ) Notice: Subject to any disclaimer, the term of this patent is extended or adjusted under 35 U.S.C. 154(b) by 139 days.

(21) Appl. No.: 16/900,651

(22) Filed: Jun. 12, 2020

(65) Prior Publication Data

US 2020/0395721 A1 Dec. 17, 2020

Related U.S. Application Data

(60) Provisional application No. 62/921,338, filed on Jun. 12, 2019.

(51) Int. Cl.

| | |
|---|---|
| ***H01R 24/76*** | (2011.01) |
| ***E05D 15/16*** | (2006.01) |
| ***E06B 7/28*** | (2006.01) |
| ***F21V 23/06*** | (2006.01) |
| ***H01R 24/28*** | (2011.01) |

(52) U.S. Cl.

CPC ..... *H01R 24/76* (2013.01); *E05D 15/165* (2013.01); *E06B 7/28* (2013.01); *F21V 23/06* (2013.01); *H01R 24/28* (2013.01); *E05Y 2900/106* (2013.01); *E05Y 2900/132* (2013.01)

(58) Field of Classification Search

CPC ..... H01R 24/76; H01R 24/28; F21V 23/06; F21V 23/04471; E05Y 2900/106; E05D 15/165; E06B 7/28; E06B 3/485; E05F 15/668

See application file for complete search history.

(56) References Cited

U.S. PATENT DOCUMENTS

| | | | | |
|---|---|---|---|---|
| 3,169,733 A | | 2/1965 | Barrett, Jr. | |
| 3,851,125 A | * | 11/1974 | Deming | E05F 15/673 200/47 |
| 4,307,271 A | * | 12/1981 | Carli | H01H 3/16 200/47 |
| 4,763,743 A | | 8/1988 | Ridgway | |
| 5,588,257 A | * | 12/1996 | Duhame | E05F 15/673 49/199 |
| 6,084,358 A | | 7/2000 | Dolson | |

(Continued)

*Primary Examiner* — Justin B Rephann

(74) *Attorney, Agent, or Firm* — Seed Intellectual Property Law Group LLP

(57) ABSTRACT

A lighting system for a door having a plurality of wheels that roll in a rail to support the door in an opened configuration and a closed configuration, the rail having an interior bounded by a pair of opposing U-shaped channels, and the system including at least one light attached to the door, a rail contact fixedly mounted in the interior of the rail, a door contact mounted on the door and electrically connectable to the at least one light, the door contact structured to move entirely within the interior of the rail and to contact the rail contact only in response to the door being in the opened configuration to convey sourced electricity to at least one light to illuminate the light in response to the door contact making electrical contact with the rail contact when the door is in the opened position.

9 Claims, 10 Drawing Sheets

(56) References Cited

U.S. PATENT DOCUMENTS

| | | | | |
|---|---|---|---|---|
| 6,572,238 | B1 | 6/2003 | Johnson | |
| 7,972,027 | B1 | 7/2011 | Hatfield | |
| 9,832,843 | B1 | 11/2017 | Porter | |
| 9,976,738 | B1 | 5/2018 | Holloway | |
| 10,090,621 | B2 | 10/2018 | Dubbaka | |
| 10,342,098 | B2 | 7/2019 | Porter | |
| 2011/0056137 | A1* | 3/2011 | Sommer | E05F 15/67 49/358 |
| 2011/0271596 | A1* | 11/2011 | Schaaf | E05F 15/668 49/358 |
| 2019/0346095 | A1* | 11/2019 | Brown | E05F 15/668 |

* cited by examiner

OVERHEAD DOOR LIGHT POWER CONNECTION SYSTEM

BACKGROUND

Technical Field

The present disclosure pertains to overhead doors and, more particularly, to a system for providing a connection between overhead doors and a power supply.

Description of the Related Art

Overhead doors often take the shape of garage doors in common household use. Because garages are often used as workshops and storage areas, adequate lighting is important, and overhead doors, when open, often block the ceiling lighting that is provided. One solution to the blocked overhead lighting problem is to provide lighting on the inside of the overhead door, such that, when the door is open and suspended overhead, the lighting on the inside of the door is switched on, lighting up the area. In this way, whether the door is open or closed, adequate lighting is available. Lighting kits that are easily attached to the inside surface of an overhead door are available.

Bringing power to the lights attached to the interior of the overhead door is one of the problems associated with this lighting solution. An electrical power storage battery carried by the door is currently not a feasible solution because of power demands of the lights, significant additional weight that a battery adds to a moving door, cost of a battery and associated recharge system, and other reasons. As a result, the power supply for an automatic, overhead door and door lights is usually installed on a nearby stationary wall or ceiling and connected to the building electrical system. Power is then routed to the overhead door in various ways.

Doors mounted on hinges oriented on a vertical axis such as the typical front door of a house, or perhaps hinged doors or windows that are hinged at the top and swing usually out and up—may require power to the door or window itself for some electrically—powered accessory such as a powered lock, light(s), decorations, or shutters. If electrical power to such a door or window is required while open, power is almost always provided via a short length of electrically conductive, well-insulated, and protected cord stationed on the hinged edge of the door or window. In this location—as opposed to the door opening edge—travel distance for the cord is relatively short, and the cord may be protected by hardware specifically designed for the purpose. All parts of an overhead door, such as a garage door, travel further than a hinged door. A short length of electrical wire that flexes minimally, as may be found on an electrically-powered swinging door, is not an adequate solution to the problem of supplying power to an overhead door.

A longer cord, capable of reaching the moving overhead door in both closed and open positions, is susceptible to tangling, pinching, stretching, and flex cycle failure of the conductor, jacketing, and insulation.

An early solution to the problem of getting power to an overhead door involved a creel onto which an adequate length of insulated electrical cord was wound. U.S. Pat. No. 7,972,027 instructs of such a method, where an electrical cord connects lights on the interior of an overhead door to a power supply. As the door is opened, a portion of the door becomes closer to the power source, and the electrical cord is automatically wound onto the spring-loaded creel. As the door is lowered, the creel spools out the same length of cord.

Problems with a power connection method such as this may be foreseen; damage associated with regular winding and unwinding of electrical cord include abrasion, potential pinching, flex stress damage, and eventual failure of the insulation or conducting wire.

Dolson (U.S. Pat. No. 6,084,358) describes a switching mechanism for an interior lighted door based upon the orientation of the switch, i.e., when the door is horizontal, the switch is closed and the electronics associated with the door are powered. However this approach does not specifically address the problem of getting power to the switch.

Johnson (U.S. Pat. No. 6,572,238) describes a garage door with instructions on exterior lighted panels on the door, as for holiday decorations, but fails to instruct on how to get power to the lights.

Other methods of connecting power to a mobile implement have been described. For example, Barrett (U.S. Pat. No. 3,169,733) describes a method to recharge battery-powered vehicles such as operator-less towing tractors. While the vehicle is idle at a certain point along its travel path, a power source is automatically connected via contact rails to the vehicle, recharging the vehicle's battery. Ridgeway (U.S. Pat. No. 4,763,743) describes a device for connecting the mechanical and hydraulic components of an implement to a tractor automatically (meaning—while the operator remains seated in the tractor). Dubakka (U.S. Pat. No. 10,090,621) describes an "automatic" (i.e., not requiring external action by a user) method of electrically connecting a vehicle, for example, to a base station for the purpose of recharging the vehicle, wherein the usually plug assembly of the connector on the vehicle relies upon gravity to connect to a receptacle connector stationed below the vehicle.

Porter (U.S. Pat. No. 9,832,843) and Holloway (U.S. Pat. No. 9,976,738) both instruct regarding "automatic" two-part power switches, one of which is mounted on and moves with the door, the other (connected to a power source) of which is mounted to the overhead door rails. Both Porter's and Holloway's solution permit the powered contact to be mounted to either left or right side rails, and to be moved forward or backward on the rail, to adjust to any particular door's length of travel. Both describe spring-loaded, low voltage contacts. Holloway's solution permits a vertical alignment of the powered side switch with the moving switch attached to the door, by means of a "holder" bracket, should that be necessary. Porter further instructs of the possible addition of a manual switch, to preclude the need to open or close the overhead door to turn the overhead door light on or off.

Both Porter's and Holloway's solutions require that the electrical contacts on the door side be "fastened to" the interior of the door (Porter), or "connectable to" an edge of a (topmost) panel of a, presumably wooden or metal, sectional door (Holloway). The method of connecting the door portion of the electrical contact assembly to the door itself is not described, but may be performed, it is assumed, by means of screws, bolts, nails, or perhaps an adhesive.

BRIEF SUMMARY

The present disclosure describes an improved low-voltage electrical connector for overhead doors and similar doors and that simplifies installation, improves reliability, shields the plug assembly from damage, and reduces the cost of purchasing and installing an overhead door light.

In accordance with one aspect of the present disclosure, an overhead door connection system is provided. The system is directed to doors constructed of a single panel or multiple panels, swung or rolled from a closed position to a usually overhead, usually horizontal position, and often used as doors for home garages, commercial building loading bays, and doors for cargo trucks and delivery vans.

In accordance with another aspect of the present disclosure, a kit for illuminating a room having a power source is provided. The illumination of the room takes place when a door, mounted on a rail having an interior defined by opposing U-shaped channels, is completely opened. The kit includes a two-part contact switch comprising a plug assembly structured to be connected to one member of a connection set consisting of the door and a structure connected to the door and to reside in the interior of the channel of the rail, and a receptacle assembly having a contact surface and configured to be mounted on one member of a mounted set consisting of a door track railing, a door opener track, and operator system; wherein the receptacle assembly is sized and shaped to reside in the interior of the channel of the rail. The kit further includes a light structured to be electrically connected to one of the plug assembly and receptacle assembly and to be mounted on an inside surface of the door, and when the door is completely opened, the plug assembly makes contact with the receptacle assembly to complete a circuit that powers the light and in turn illuminates the room.

In accordance with still yet another aspect of the present disclosure, the plug assembly is structured to be attached to the door and to move within the interior of the rail in response to movement of the door, and the receptacle assembly is structured to be fixedly attached inside the interior of the rail and in alignment with the plug assembly.

In accordance with a further aspect of the present disclosure, the plug assembly has a pair of electrical prongs extending from a nose and the receptacle assembly has a recessed area to receive the electrical prongs and the nose of the plug assembly in slidable engagement.

In accordance with another implementation of the present disclosure, a kit for use in illuminating a room in response to a door being moved to an opened condition and in extinguishing illumination of the room in response to the door being moved out of the opened condition is provided. The door is mounted on a door track system that includes a rail having an interior defined by two opposing U-shaped channels. The kit includes a two-part contact switch that includes a door contact connectable to the door and sized and shaped to reside in and move within the interior of the rail, the door contact switch having at least one contact surface, and a rail contact having a contact surface and configured to be fixedly attached to the interior of the rail, wherein the door contact is structured to contact the rail contact in response to the door being moved to the opened condition and complete an electric circuit to illuminate the light.

In accordance with another implementation of the present disclosure, a lighting system is provided. The lighting system includes a door having a plurality of wheels, a rail structured to receive the wheels in rolling engagement and to support the door in an opened configuration and a closed configuration, the rail having an interior bounded by a pair of opposing U-shaped channels, at least one light attached to the door, a rail contact fixedly mounted in the interior of the rail, a door contact mounted on the door and electrically connectable to the at least one light, the door contact structured to move within the interior of the rail and to contact the rail contact only in response to the door being in the opened configuration, and a power adaptor electrically connected to the rail contact and structured to convey sourced electricity to the at least one light via the rail contact and the door contact to illuminate the light in response to the door contact making electrical contact with the rail contact when the door is in the opened position.

In accordance with still yet another aspect of the present disclosure, the one of the rail contact and the door contact comprises a pair of electrically conductive prongs, and wherein the other of the rail contact and the door contact comprises an electrically conductive contact plate.

In accordance with yet a further aspect of the present disclosure, the rail contact is positioned on the rail to be in alignment with the door contact to receive the door contact in slidable engagement and in electrical contact when the door is in the opened configuration.

As will be appreciated from the foregoing, the kit and lighting system present disclosure provides numerous advantages and benefits over prior designs, including (a) providing a power connection for an overhead door that is easy and time-efficient for an untrained person to install; (b) providing a power connection for an overhead door that is robust, reliable, and requires little maintenance; (c) providing a power connection for an overhead door that is protected from accidental damage; providing a power connection for an overhead door that may be installed and used on either support rail; and providing a power connection for an overhead door that is safe to use, install, repair.

DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

Figure 1:
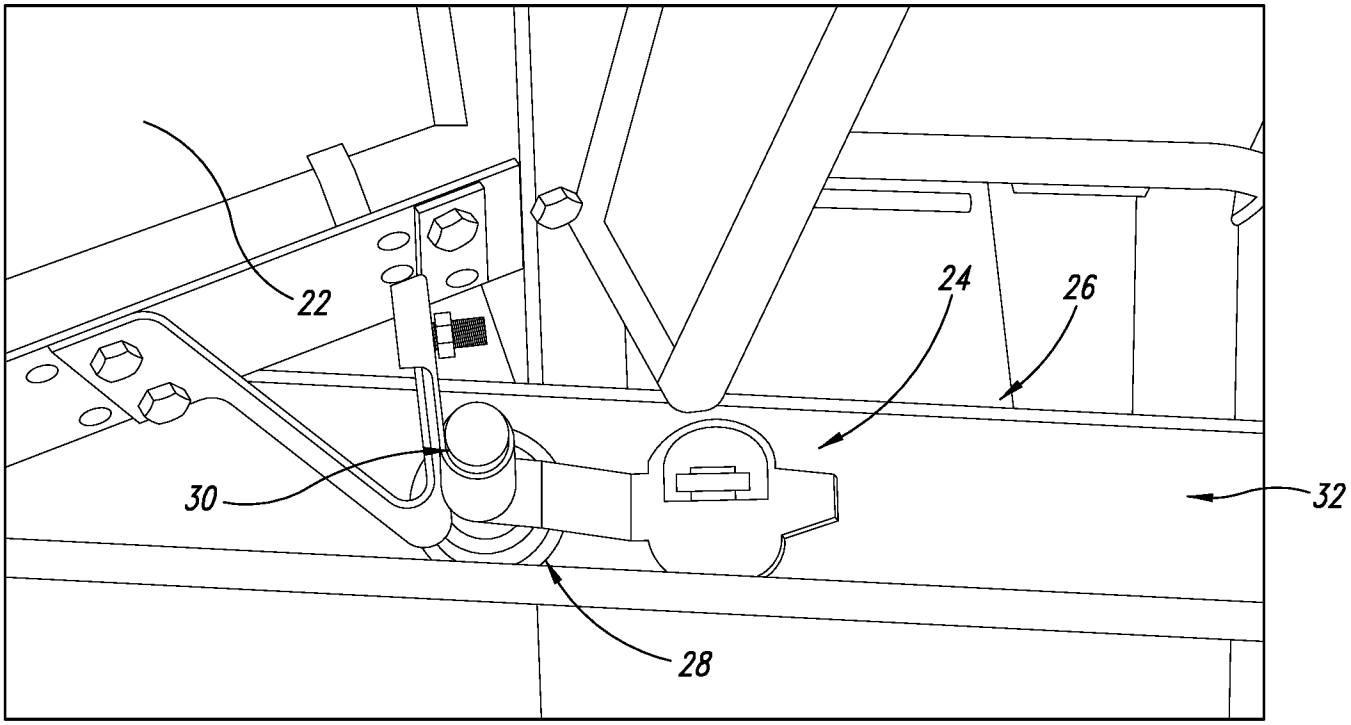
FIG. 1 illustrates a portion of an overhead garage door with a component of the system of the present disclosure installed thereon.

The present disclosure will now be described more fully hereinafter with reference to the accompanying drawings, in which exemplary implementations of the disclosure are shown. This disclosure may, however, be embodied in many different forms and should not be construed as limited to the implementations set forth herein. Rather, these implementations are provided so that this disclosure will be thorough and complete, and will fully convey the scope of the disclosure to those skilled in the art. Like reference numerals refer to like elements throughout.

The terminology used herein is for the purpose of describing particular implementations only and is not intended to be limiting of the disclosure. As used herein, the singular forms "a," "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around," "about" or "approximately" shall generally mean within 20 percent, preferably within 10 percent, and more preferably within 5 percent of a given value or range. Numerical quantities given herein are approximate, meaning that the term "around," "about" or "approximately" can be inferred if not expressly stated. Also, as used herein, the term "plurality" means a number greater than one.

This present disclosure is an improved, low voltage power connector for an overhead door light, such as an overhead door light described in applicants' prior U.S. Pat. Nos. 9,832,843 and 10,342,098). It should be noted that the problem of blockage of a room or large vehicle overhead light can occur whether or not an overhead door is manually or automatically opened and closed. The kit and system disclosed herein serves any overhead door—manual or automatic—with a suitable source of low voltage power sufficient to power a light or lights. The phrase "low voltage," in this context, is defined as 0-49 volts—a voltage low enough such that risk of human electrical shock is minimal.

Often, overhead door lights, whether for a home garage door or a business or vehicle overhead door, are installed as an aftermarket item. Simplicity of installation is an important feature, as the process is often performed by untrained personnel. Simplicity of installation is one of the objects of this disclosure.

And while garage door mechanical linkages, automatic door opener systems, and LED panel lights have been in use for many years, with many of the functional problems worked out for these systems over that time, an unreliable power connection is a common failure mode for lighting systems attached to the inside surface of a movable door. Reliability of service with minimal maintenance is another object of this disclosure.

Many garages, warehouses, delivery trucks, and other potential settings for an interior overhead door light are often filled with merchandise, tools, stored materials, etc., that may clutter the area immediately above and around a door that opens and closes regularly. Movement of the door can cause shifting of this clutter and can interfere with the door's function, and can damage the door or portions thereof. Another object of this disclosure is to reduce the overall size of the power connection portion of an overhead door light, and to locate the male (or plug) and receptacle (or socket) portions of the power connector within or immediately around the supporting rails common to most overhead doors, thus minimizing the risk of knocking out of alignment and damaging the two power connectors.

As will be described more fully below, the present disclosure provides a design and system that permits the user to attach the power connector to either of the two rails typically used to guide and support overhead doors.

Generally, the lighting system includes a door having a plurality of wheels, a rail structured to receive the wheels in rolling engagement and to support the door in an opened configuration and a closed configuration, the rail having an interior bounded by a pair of opposing U-shaped channels, at least one light attached to the door, a rail contact fixedly mounted in the interior of the rail, a door contact mounted on the door and electrically connectable to the at least one light, the door contact structured to move within the interior of the rail and to contact the rail contact only in response to the door being in the opened configuration, and a power adaptor electrically connected to the rail contact and structured to convey sourced electricity to the at least one light via the rail contact and the door contact to illuminate the light in response to the door contact making electrical contact with the rail contact when the door is in the opened position.

In one implementation a kit is provided that generally includes the components to be described more fully below. More particularly, a kit is provided for use in illuminating a room in response to a door being moved to an opened condition and in extinguishing illumination of the room in response to the door being moved out of the opened condition is provided. The door is mounted on a door track system that includes a rail having an interior defined by two opposing U-shaped channels. The kit includes a two-part contact switch that includes a door contact connectable to the door and sized and shaped to reside in and move within the interior of the rail, the door contact switch having at least one contact surface, and a rail contact having a contact surface and configured to be fixedly attached to the interior of the rail, wherein the door contact is structured to contact the rail contact in response to the door being moved to the opened condition and complete an electric circuit to illuminate the light.

Figure 2:
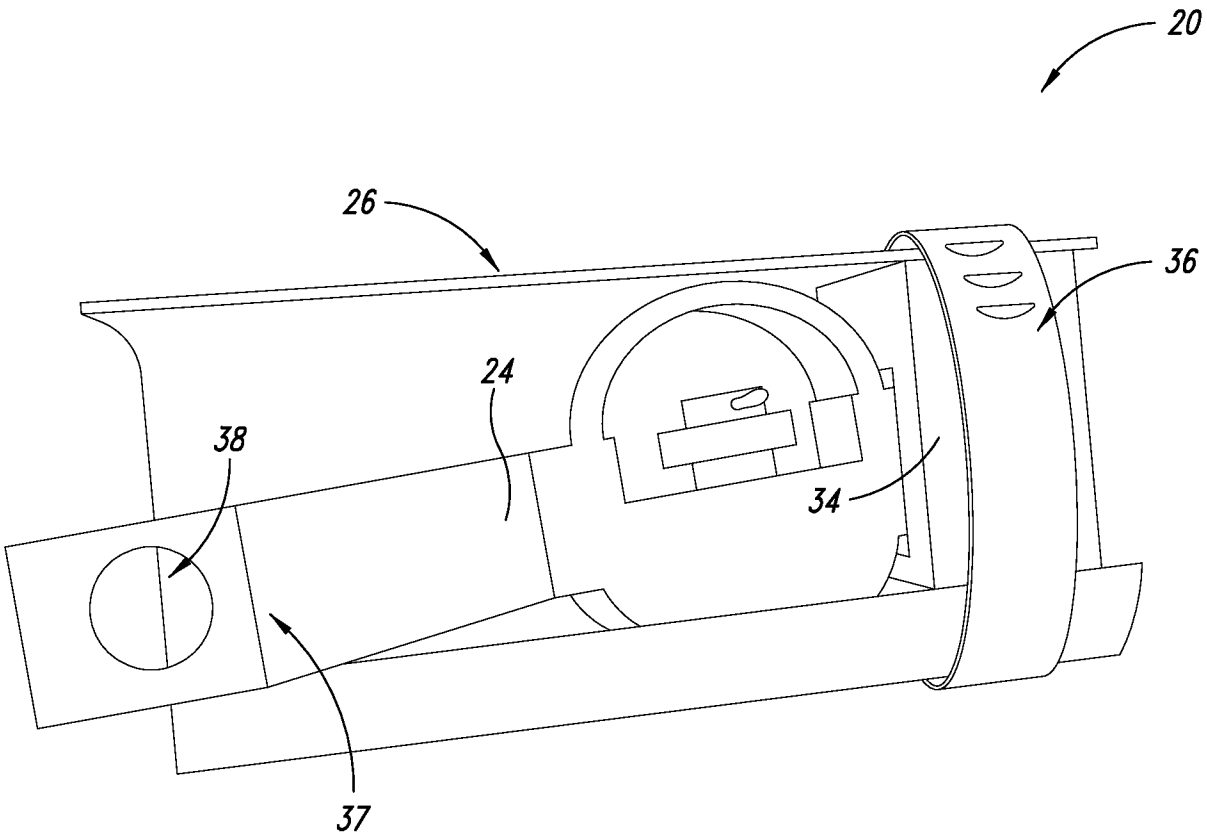
FIG. 2 illustrates a segment of a rail on an overhead garage door rail showing the plug and receptacle power connection components of the present disclosure used in association with the rail.
Figure 3:
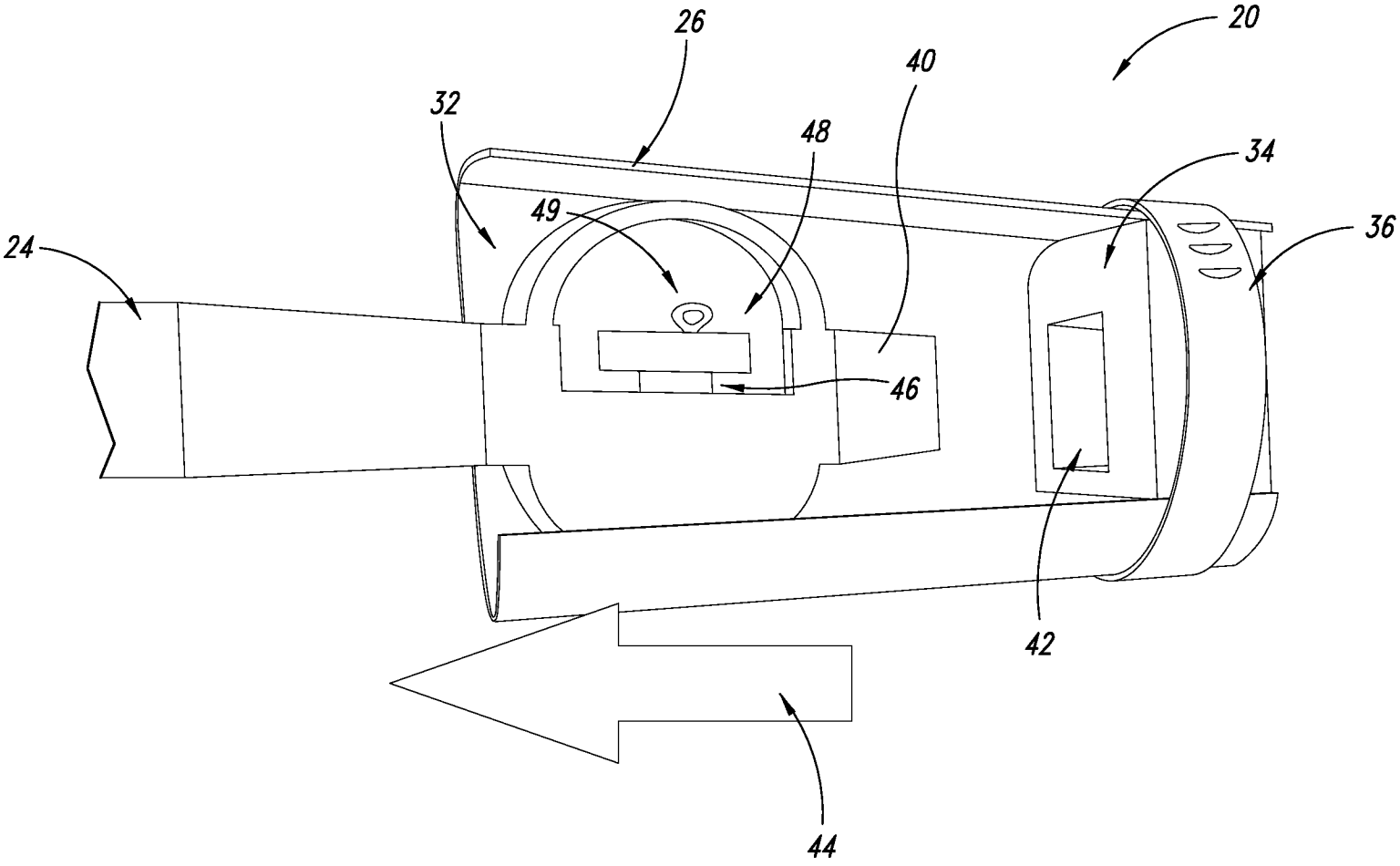
FIG. 3 illustrates the male or plug portion of the power connection system disconnected from receptacle the shown in FIG. 2.

FIGS. 1-3 illustrate a power connection system 20 formed in accordance with the present disclosure that is used in connection with an overhead garage door 22. The system 20 can include the door 22 and its related mounting hardware, or the system 20 can be just the components described in more detail below. The power connection system 20 includes without limitation a plug assembly 24 that is mounted within and being guided, as the door 22 opens and closes, by one of two guide rails 26. Typical overhead door systems rely upon low friction wheels 28 attached to the door 22 to support and guide the door 22 as it opens and closes. The wheel 28 is connected to the door 22 via an axle 30 that is rotatably attached to the overhead door 22. Not shown in these illustrations are the electrical contacts and wires, which are shown in later figures herein. The power connection components illustrated in FIGS. 1-3 show possible placement within the interior 32 of the rail 26 only.

FIG. 2 shows a segment of the rail 26 having mounted therein the plug assembly 24 and a receptacle assembly 34 of the power connection system 20, the latter component held into the rail 26 by a clamp 36. The plug assembly 24 has a mounting bracket 37 with a transverse opening 38 at a distal end that is sized and shaped to accept the axle 30, which provides for a connection to the door 22. In one implementation, the plug assembly 24 and receptacle assembly 34 components illustrated herein would typically be manufactured using a thermoplastic injection molding process.

As shown in FIG. 2, the plug assembly 24 has a plug 40 that is sized and shaped to be slidably received within a receptacle 42 on the receptacle assembly 34. In use, the action of the door 22 in the rail 26 would drive the plug assembly 24 forward. Because the plug 40 is aligned with the receptacle 42, it is slidably received therein as the door 22 moves from a closed condition to an opened condition. The receptacle assembly 34 is positioned on the rail 26 by means of the clamp 36 or other fastening means to reside immovably at the end of the plug assembly's 24 forward motion, such that electrical contact between the plug 40 and the receptacle 42 would just occur at the end of travel of the door 22, which in this implementation is when the door 22 is completely open. Both the plug 40 and the receptacle 42 have electrical contacts within them such that when the plug 40 is received within the receptacle 42 the electrical contacts make a connection, permitting electricity to flow through the connection. The electrical connection permits power to reach the lights on the inside of the door, thereby lighting the room, garage, warehouse, or vehicle.

The mounting of the receptacle assembly on the rail 26, particularly in the interior 32 of the rail 26, is easier, offers more reliable alignment, and better protection from accidental damage, than attaching a power connector box to the rail with adjustable clamps, screws, bolts, or adhesives, as known designs require.

In FIG. 3, the plug 40 of the plug assembly 24 has been withdrawn from the receptacle 42, such as in response to the overhead door 22 moving to the closed configuration, or at least away from the opened configuration (door 22 moving in the direction of the arrow 44 shown in FIG. 3). The electrical connection would at that time be severed, causing the door lights to go out. The parts used in this and the above illustrations are not equipped with the actual electrical contacts or wires, but are meant to illustrate broadly the positioning and function of the power connectors relative to the key portions of the automatic overhead door.

Also shown in FIG. 3 on the plug assembly 24 is a protrusion 46 designed to accept a doughnut-shaped magnet 48, which is held to the protrusion by a cotter pin 49. The magnet 48 is designed to roll around the protrusion 46 as the door 22 moves along the rail 26. The magnet 48 functions to hold the plug assembly 24 upright and proximate to the rail 26 channel as the overhead door 22 opens and closes, thus allowing the plug 40 to align with the receptacle 42.

Figure 4:
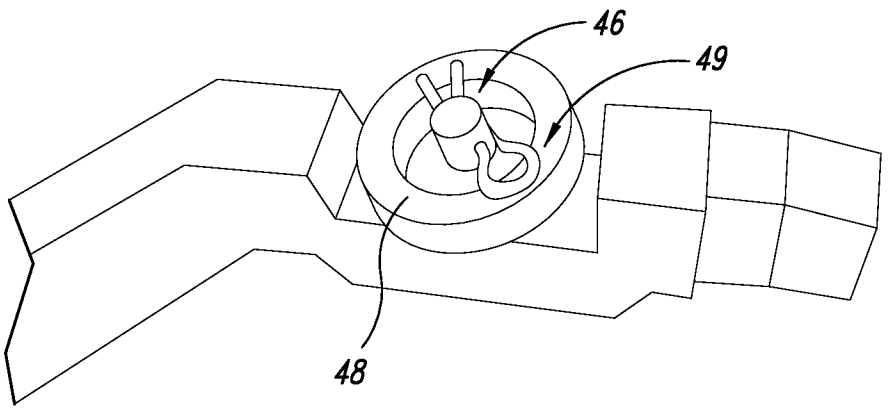
FIG. 4 shows a magnet and one possible attachment means as seen from an overhead angle of the plug component formed in accordance with the present disclosure.

FIG. 4 shows the magnet 48 and one possible attachment means described above as seen from an overhead angle. Note that use of a magnet 48 to hold any portion of the improved overhead door power connection assembly in the interior 32 of the rail 26 is only one possible method of serving this function, as will be described below. One or more magnets, used to keep the mobile portion of the power connection system 20 in close association with the overhead door rail 26, may be situated on a top, bottom, or side (or any combination of the foregoing) of the connector.

A preferred implementation uses a magnet 48, whether held by a protrusion 46 and rolling directly along the interior 32 of the rail 26, or inserted within the plug assembly's 24 structure (but without direct contact to the metal of the rail, to avoid frictional wear of the magnet), to hold the movable plug assembly 24 in close proximity to the upper corner of the rail Note also that the plug 40 need not be associated with the moving door, and the receptacle need not be associated with a stable rail attachment. The plug 40 and receptacle 42 could be switched in their mounting positions so that the plug assembly 24 is attached to the rail 26 and the receptacle assembly 34 is attached to the door 22. Or such designations could be made moot with use of coaxial or other power connector options. It will be appreciate from the foregoing that the present disclosure uses the overhead door rails to contain, protect, and guide the plug 40 (or receptacle 42 as the case may be) with a low voltage, indoor system. This differs from other overhead door light power connectors, which are typically associated with the moving door in a more exposed, complicated, expensive, and less reliable method.

As will be appreciated from the foregoing, the plug assembly 24 and the receptacle assembly 34 both reside entirely in the interior 32 of the rail 26. The interior 32 is bounded by the two opposing U-shaped channels, each channel described below as a U-shaped roller alignment channel 128. Having both the plug assembly 24 and receptacle assembly 34 mounted entirely within the interior space 32 of the rail 26 provides protection for these two components and facilitates installation. For example, the clamp 36 can be a well-known hose clamp that encircles the rail 26 and the receptacle component 34. This type of attachment simplifies installation while permitting easy adjustment in the position of the receptacle assembly 34 relative to the plug assembly 24 when the door is in the fully opened configuration.

Some other possible designs are shown below and illustrated in the accompanying drawings.

Figure 5:
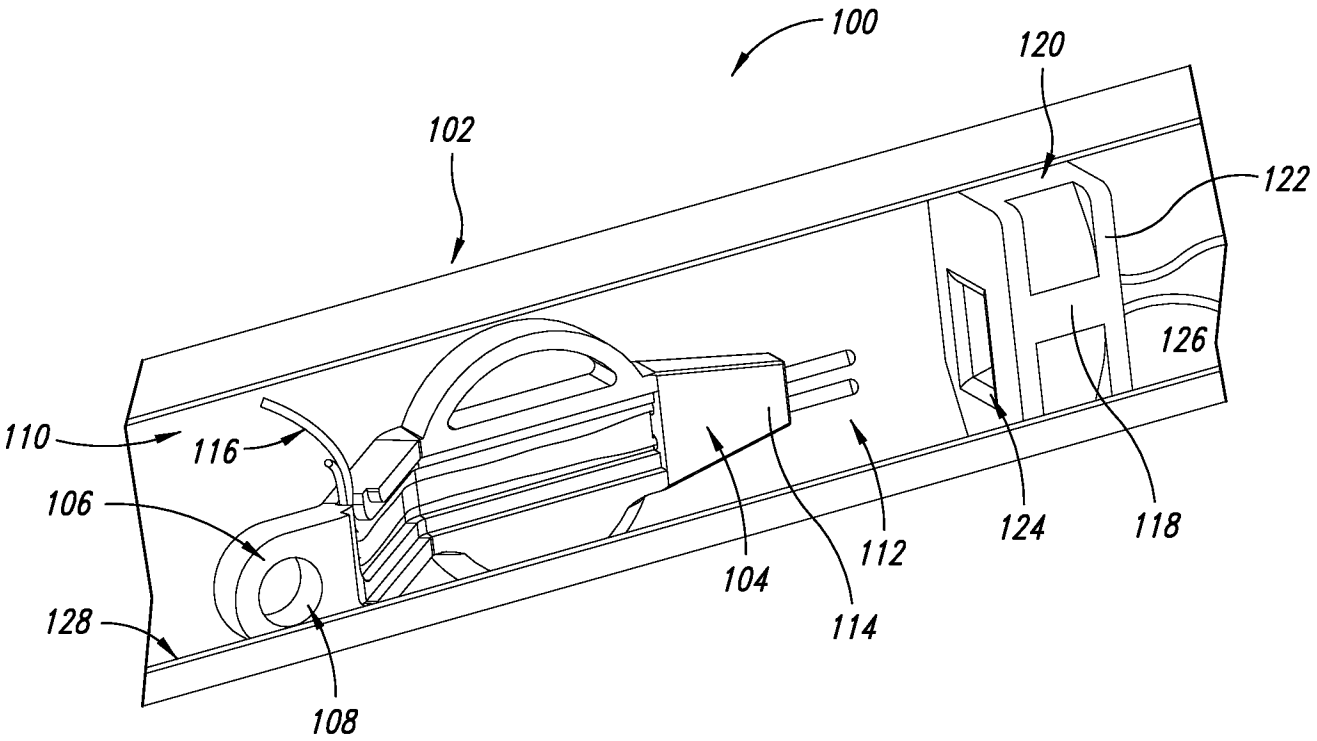
FIG. 5 depicts an alternative design of an overhead door light power connection system formed in accordance with the present disclosure.

FIG. 5 depicts another possible form for an overhead door light power connection system 100 in which a door (not shown) is mounted to roll or slide in a rail 102. A plug assembly 104 is provided, preferably manufactured using a thermoplastic injection molding process using one or a blend of any number of thermoplastics such as an HDPE, POM, PP, Nylon, or other injection moldable polymer with adequate tensile and compressive strength, resistance to abrasion, and perhaps dielectric properties. The plug assembly 104 includes a distal tab 106 having a transverse opening 108 formed therein to receive an axle (not shown) that is attached to the door and on which a support wheel is attached. The support wheel is sized and shaped to ride in an interior 110 of the rail 102 as described in the prior implementation of FIGS. 1-4. The transverse opening 108 connects to a topmost support door roller axle. Metal prongs 112 extend from a nose 114 of the plug assembly 104, and are preferably molded into the nose 114 or inserted permanently after molding, and are functionally electrically connected to wires 116, which lead to lights not shown) on the overhead door. A receptacle assembly 118, shown here (as in earlier illustrations) as "stationary-in-use," meaning the receptacle assembly 118 is fixed in place by a rail connection means such as a clamp (not shown in FIG. 5) set in a groove 120 formed in the receptacle assembly housing 122, within an overhead door rail. When installing the system, the receptacle assembly 118 is mounted inside the interior 110 of the rail 102. When the overhead door is in the "full open" position the corresponding plug assembly 104, which moves inside the rail and is connected to, and moves in association with, the axle of a topmost door support roller, mates with a corresponding receptacle 124 in the receptacle assembly 118, and the prongs 112 contact electrical contacts (not shown) in the receptacle assembly 118.

Preferably the nose 114 and prongs 112 are guided into the plug assembly by having the receptacle indented inside the receptacle assembly 118, which leads to metal sockets (not shown) and thereafter to wires 126 that connect to a power supply (not shown), such as a building's 120 volt AC supply.

Instead of a magnet as shown in design versions depicted in illustrations above, the plug assembly 104 shown in FIG. 5 relies upon stiffness of its connection with the roller axle, stiffness of its own structure, and the fact that it rides within a U-shaped roller alignment channel 128 at the base of the overhead door rail 102 to insure alignment with the receptacle 124. Such reliance on structural stiffness need not be associated with this particular design, but could also be achieved with other designs, such as are shown below. A magnet or magnets in any form is not a requirement to achieve the improvements to the art that are presented in this application.

Figure 6:
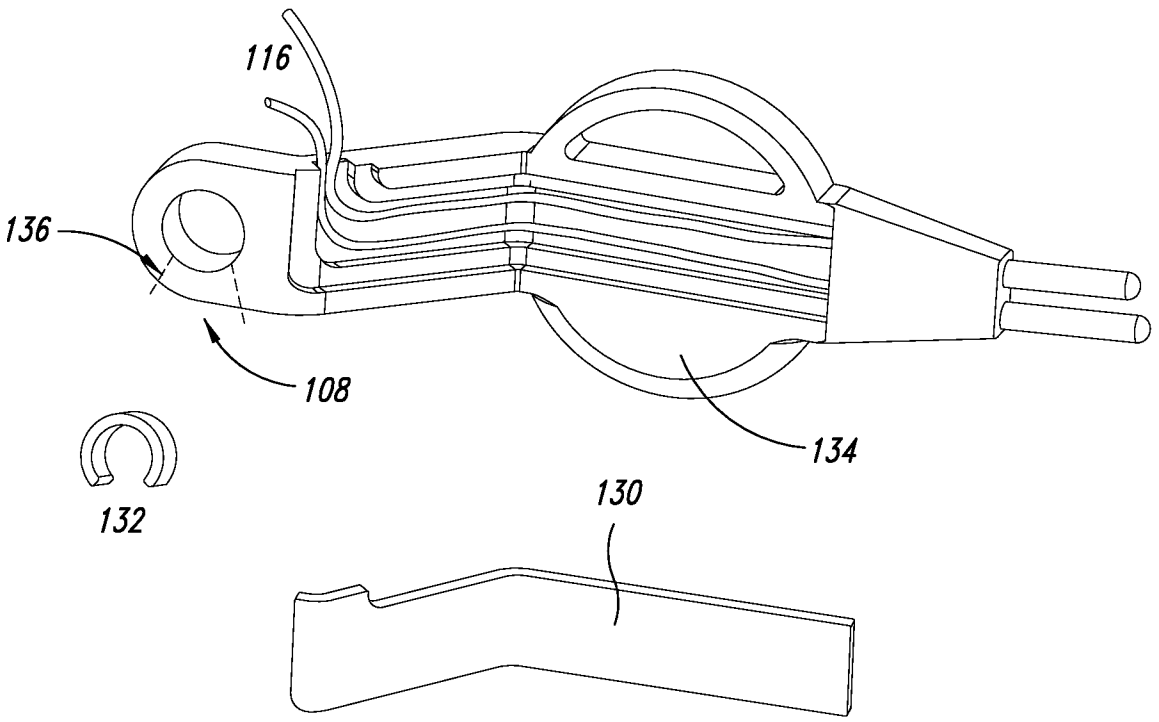
FIG. 6 is an enlarged illustration of a male or plug portion of the power connection system of FIG. 5.

For example, FIGS. 5 and 6 show more details of the plug assembly 104, including a wire cover 130 and a split bushing 132. This bushing 132, which is slightly broader or wider in dimension than cross-sectional thickness of the plug assembly housing 134 in the location of the opening 108, is snapped over the topmost wheel axle. Its purpose is to insure there is an adequate gap between:

a) the hardware that connects the roller and axle assembly to the door, and b) the roller itself.

Overhead door support rails are not always in perfect alignment. As a door opens and closes, the gap between door and support rollers will change over the course of the door's travel. The addition of the bushing 132, snapped over the topmost door support roller's axle between the roller and the door hardware, insures a reliable gap, and prevents pinching and excessive wear of a plastic or soft metal plug assembly of the plug and receptacle assembly that would otherwise occur around the opening 108.

In FIG. 6, the dash marks 136 indicate how the part could be designed to allow snap-on attachment of the assembly to the roller axle (4 in FIG. 1) over the bushing (22). The wire cover 130 may be part of the plug assembly 104 to protect the wires 116 from damage.

Figure 7:
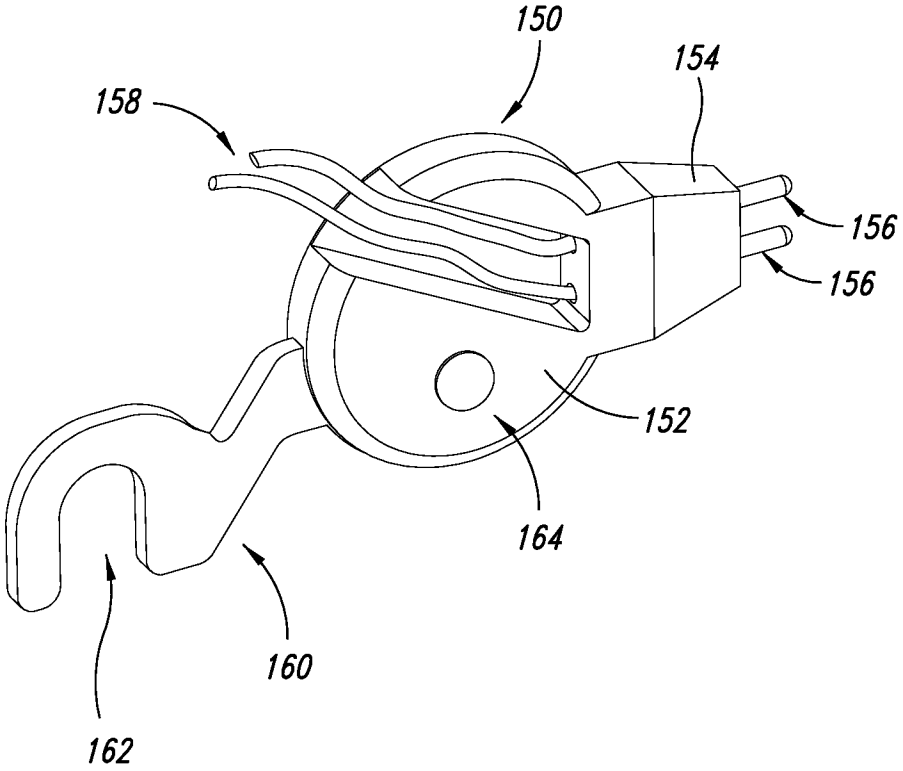
FIG. 7 illustrates yet another alternative version of a male or plug portion of the power connection system formed in accordance with the present disclosure.

FIG. 7 depicts still another implementation of a plug assembly 150 with functions as described in the foregoing illustrations with some modifications. The plug assembly 150 includes a body 152 that is preferably an injection molded piece, with a nose 154 having metal prongs 156 extending therefrom connected to wires 158 leading to door lights (not shown) as described above. A bracket 160 extends from the body 152 and includes a U-shaped opening 162 or open yoke that is sized and shaped to slip over an axle on a door. The bracket 160 may be a metal piece that is either molded into the body 152 or assembled with the body 152 in a post-molding operation, using separate hardware such as pin(s), screw(s), an adhesive, or other method, or snapped or press-fit into place. The bracket 160 precludes the need for a bushing described in FIG. 6. A pin 164 illustrates the possible use of a plastic or metal pin or other piece of hardware, such as a screw, to permit a user to easily and quickly disassemble the bracket 160 from the body 152, to change the bracket's orientation relative to the body 152, or to change out the bracket 160 for one of a different shape or bend, such as a dogleg or offset (shown in FIG. 7), thereby making the assembly compatible with another automatic door system, or allowing the user to use a different rail on an existing door system, thereby precluding the necessity of creating another expensive injection mold to make a part for that purpose.

Figure 8:
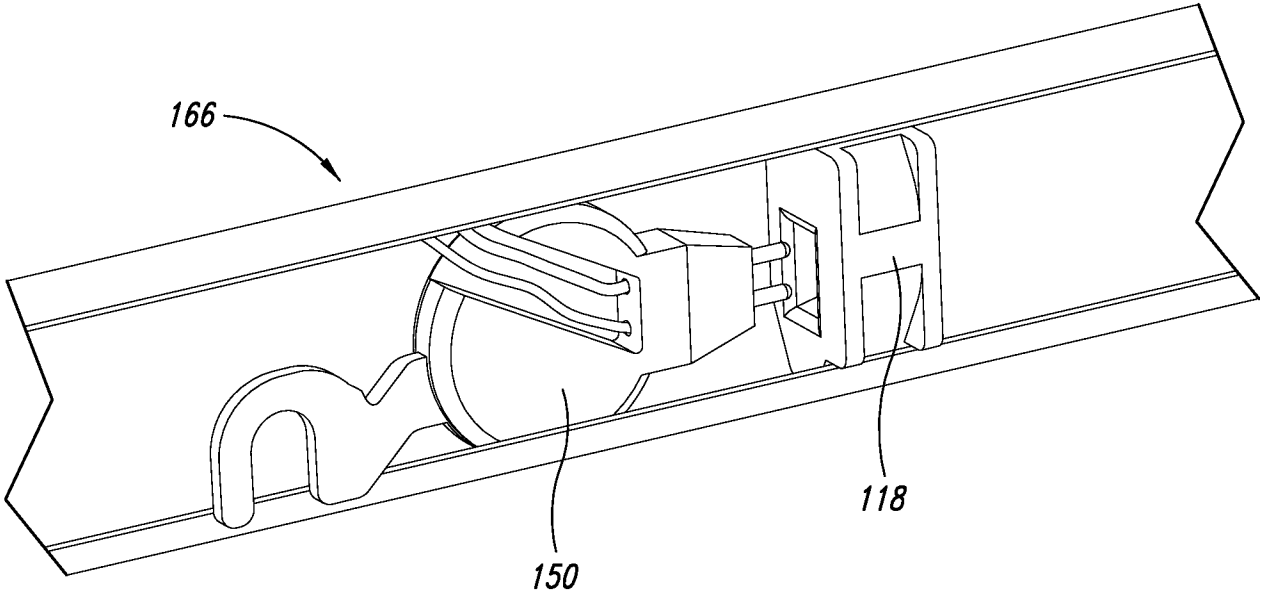
FIG. 8 illustrates the power connection system shown in FIG. 7 in conjunction with an overhead door rail.

FIG. 8 illustrates the plug assembly 150 described in FIG. 7, now in conjunction with an overhead door support or guide rail 166. Proper orientation of the plug assembly 150 relative to the receptacle assembly 118 depends upon:

a) a receptacle 124 or socket portion (in this example) that is firmly set into the proper position relative to the rail 166 ("full-open" door position), and b) a plug assembly 150 that has a predictable path relative to the rail and the moving door. No other X/Y/Z variables (horizontal (X and Z) and vertical (Y)) need to be compensated for with the present design.

The use of an open yolk 162 to install the plug assembly 150 to an overhead door's topmost roller axle is easier and requires less time than removing the roller and axle to install the plug assembly 150, as would be necessary in the assemblies shown in FIGS. 1-4. And it is more convenient than attaching a connector box to the door with screws, bolts, nails, or adhesives, as the current art requires.

Figure 9:
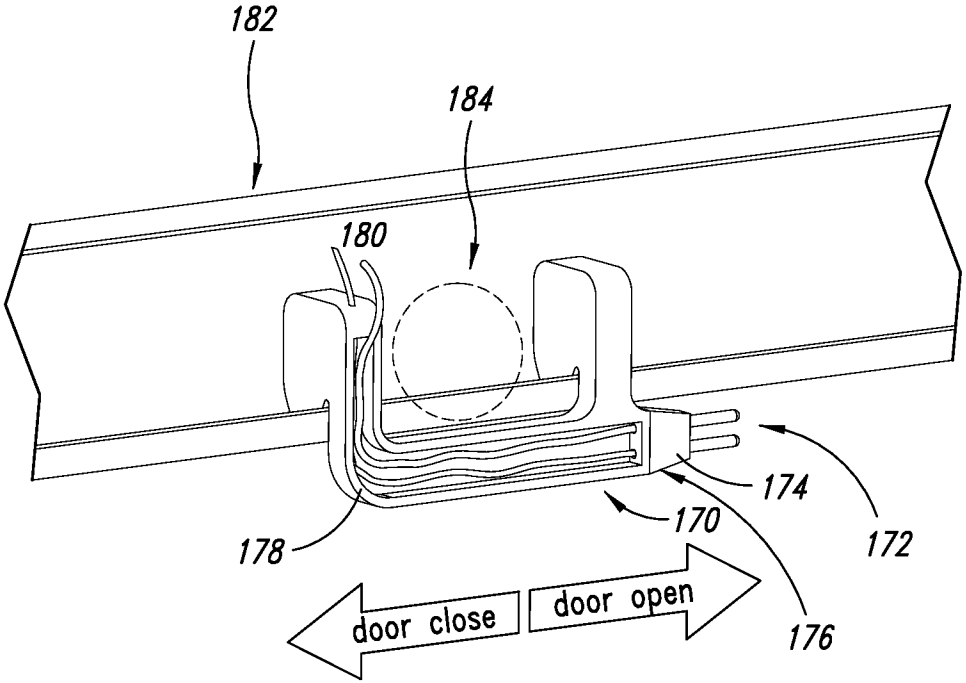
FIG. 9 illustrates another implementation of the present disclosure for a mobile portion of the male or plug component of the power connection system.

FIG. 9 shows another option for the mobile portion of the power connection system—in this case, illustrated again as a plug assembly 170. Once again, there are two metal prongs 172 extending from a nose 174 on a forward end 176 of a body 178 that are connected electrically to wires 180 that lead to door lights (not shown). The metal prongs 172 will, as the door opens (in this case, moving toward the right), connect to a socket or receptacle connector (not illustrated here). What moves the plug assembly 175 along the rail 182 is the topmost roller 184 (seen in dashed outline form here) that is attached or connected to the door via an axle. The plug assembly 175 slides left or right, pushed by the topmost roller, depending upon whether the door opens or closes. It is held in its orientation relative to the (in this case receptacle) connector by its overall profile or shape relative to the bottom (or top) of the rail, and with the help of an optional imbedded magnet or magnets. A similar design could attach to the top of the rail, relying on a magnet or magnets to hold its orientation as it is slid along by the roller. This method of attaching the plug assembly to the door requires no removal of rollers or other door hardware. The installer simply inserts the plug assembly into the interior of the rail or rail groove, and attaches wires to door lights. This is less complicated for an unskilled installer than attaching a plug assembly box to the door with screws, bolts, nails, or adhesives, as the current art requires. This solution may be installed on either door rail, and over a wide range of wheel sizes.

Figure 10:
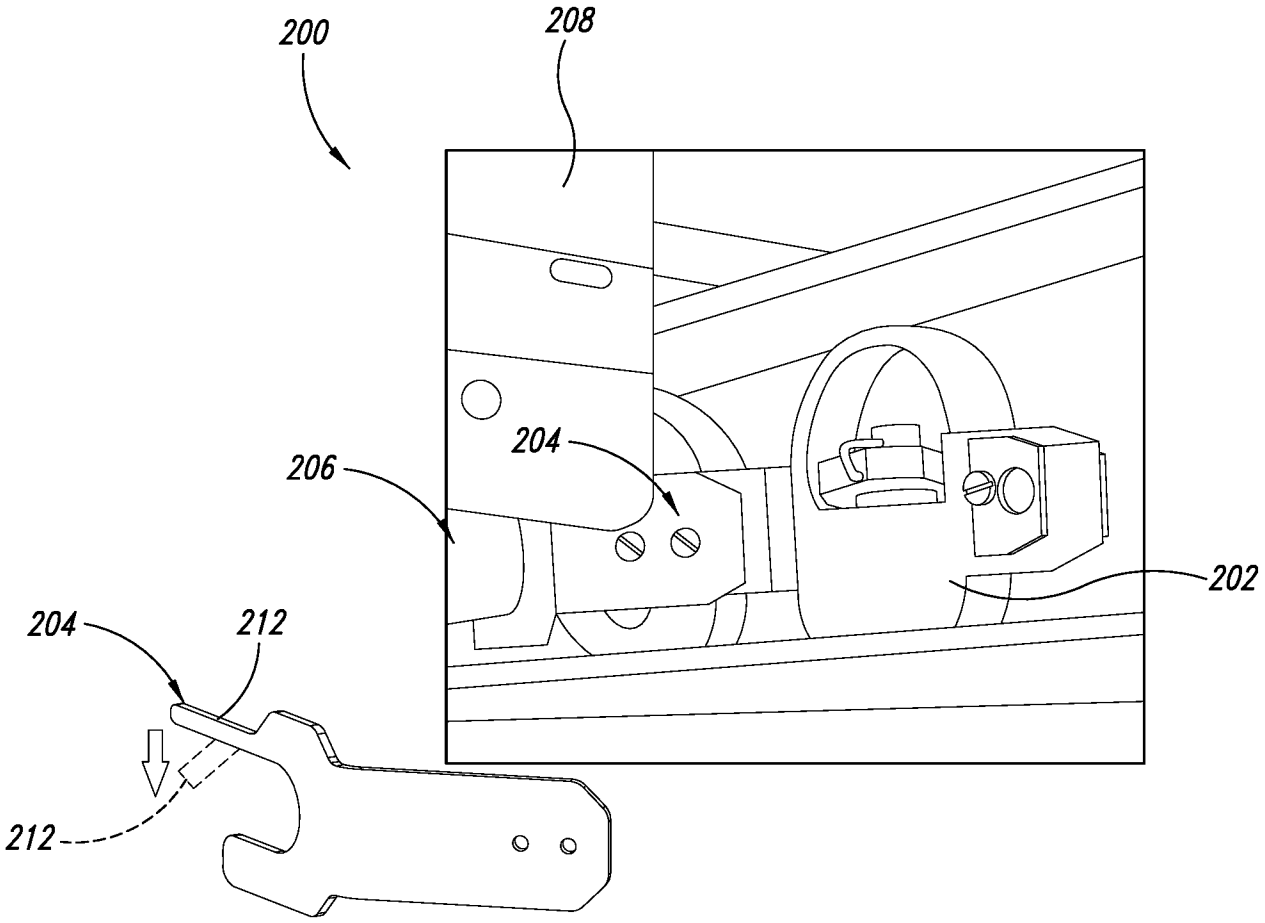
FIG. 10 illustrates a male or plug component of the power connection system of the present disclosure attached to the door wheel assembly similar in design to those shown in FIGS. 1, 2, 3, and 4

FIG. 10 illustrates a functional prototype of a system 200 formed in accordance with the present disclosure using plug assembly that can be similar in design to those described above or in a different configuration as shown herein. In the plug assembly 202 shown in FIG. 10 a yoke 204 is provided at the junction of the roller axle and door axle support hardware 206. This yoke 204 (also shown in the illustration's inset) is slipped over the door roller axle when connecting the plug assembly 202 to the door 208. In this design, a tab 212 is then bent downward, as shown in the illustration's inset, to hold the plug assembly 202 in place over the roller axle when the door 208 closes. Aluminum is a preferred but not the only material that is soft enough to bend by hand as in this application, given the proper dimensional, heat treatment, and other constraints. Other metals, polymers, or composites could also serve. A bendable tab 212 such as this is a design option to quickly and easily attach and hold the plug assembly 202 to a roller axle.

This method of installing the male connector to the door is easier than removing the roller/axle, which would be necessary in the assemblies shown in FIGS. 1-4, and it is certainly more convenient than attaching a connector box to the door with screws, bolts, nails, or adhesives, as the current art requires.

The various implementations described above can be combined to provide further implementations. Aspects of the implementations can be modified, if necessary to employ concepts of the various patents, applications and publications to provide yet further implementations.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A kit for illuminating a room having a power source, the illumination of the room taking place when a door, mounted on a rail having an interior defined by opposing U-shaped channels, is completely opened, the kit comprising:

a two-part contact switch comprising:

a plug assembly structured to be connected to one member of a connection set consisting of the door and a structure connected to the door and to reside entirely in the interior of the channel of the rail, the plug assembly having a pair of electrical contacts extending therefrom; and a receptacle assembly having an electrically conductive contact surface and configured to be mounted on one member of a mounted set consisting of a door track railing, a door opener track, and operator system; wherein the receptacle assembly is sized and shaped to reside entirely in the interior of the channel of the rail;

a light structured to be electrically connected to one of the plug assembly and receptacle assembly and to be mounted on an inside surface of the door; and wherein when the door is completely opened, the pair of electrical contacts extending from the plug assembly make electrical contact with the electrically conductive contact surface in the receptacle assembly to complete an electrical circuit through the pair of electrical contacts and the contact surface that powers the light and in turn illuminates the room.

2. The kit for illuminating the room of claim 1, wherein the plug assembly is structured to be attached to the door and to move within the interior of the rail in response to movement of the door, and the receptacle assembly is structured to be fixedly attached inside the interior of the rail and in alignment with the plug assembly.

3. The kit for illuminating a room of claim 1, wherein the pair of electrical contacts in the plug assembly comprise a pair of electrical prongs extending from a nose and the receptacle assembly has a recessed area to receive the electrical prongs and the nose of the plug assembly in slidable engagement.

4. A kit for use in illuminating a room in response to a door being moved to an opened condition and in extinguishing illumination of the room in response to the door being moved out of the opened condition, the door mounted on a door track system that includes a rail having an interior defined by two opposing U-shaped channels, the kit comprising:

a two-part contact switch that includes:

a door contact connectable to the door and sized and shaped to entirely reside in and move within the interior of the rail, the door contact having two electrical contacts; and a rail contact having a contact surface and configured to be fixedly attached to and reside entirely within the interior of the rail, wherein the two electrical contacts are structured to contact the rail contact in response to the door being moved to the opened condition and complete an electric circuit that includes the two electrical contacts and the rail contact to illuminate the light.

5. A lighting system, comprising:

a door having a plurality of wheels;

a rail structured to receive the wheels in rolling engagement and to support the door in an opened configuration and a closed configuration, the rail having an interior bounded by a pair of opposing U-shaped channels;

at least one light attached to the door;

a rail contact fixedly mounted to and residing entirely within the interior of the rail;

a door contact mounted on the door and electrically connectable to the at least one light, the door contact structured to reside entirely within and to move within the interior of the rail and to contact the rail contact only in response to the door being in the opened configuration;

a power adaptor electrically connected to the rail contact and structured to convey sourced electricity to the at least one light via the rail contact and the door contact to illuminate the light in response to the door contact making electrical contact with the rail contact when the door is in the opened position.

6. The lighting system of claim 5 wherein the one of the rail contact and the door contact comprises a pair of electrically conductive prongs, and wherein the other of the rail contact and the door contact comprises an electrically conductive contact plate.

7. The lighting system of claim 5 wherein the rail contact is positioned on the rail to be in alignment with the door contact to receive the door contact in slidable engagement and in electrical contact when the door is in the opened configuration.

8. A kit for illuminating a room having a power source, the illumination of the room taking place when a door, mounted on a rail having an interior defined by opposing U-shaped channels, is completely opened, the kit comprising:

a two-part contact switch comprising:

a plug assembly structured to be connected to one member of a connection set consisting of the door and a structure connected to the door and to reside in the interior of the channel of the rail, the plug assembly having a pair of electrical prongs extending from a nose and the receptacle assembly has a recessed area to receive the electrical prongs and the nose of the plug assembly in slidable engagement; and a receptacle assembly having a contact surface and configured to be mounted on one member of a mounted set consisting of a door track railing, a door opener track, and operator system; wherein the receptacle assembly is sized and shaped to reside in the interior of the channel of the rail;

a light structured to be electrically connected to one of the plug assembly and receptacle assembly and to be mounted on an inside surface of the door; and wherein when the door is completely opened, the plug assembly makes contact with the receptacle assembly to complete a circuit that powers the light and in turn illuminates the room.

9. The kit for illuminating the room of claim 8, wherein the plug assembly is structured to be attached to the door and to move within the interior of the rail in response to movement of the door, and the receptacle assembly is structured to be fixedly attached inside the interior of the rail and in alignment with the plug assembly.

* * * * *